US006166486A

United States Patent [19]

Jee

[11] Patent Number: 6,166,486

[45] Date of Patent: Dec. 26, 2000

[54] PIXEL FOR DISPLAY AND METHOD OF FORMING SAME

[75] Inventor: Sung Hun Jee, Pusan-si, Rep. of Korea

[73] Assignee: Samsung Display Devices Co., Ltd., Kyungki-do, Rep. of Korea

[21] Appl. No.: 09/107,832

[22] Filed: Jun. 30, 1998

[30] Foreign Application Priority Data

| | | | |
|---|---|---|---|
| Jul. 2, 1997 | [KR] | Rep. of Korea | 97-30689 |
| Aug. 22, 1997 | [KR] | Rep. of Korea | 97-40175 |
| Aug. 30, 1997 | [KR] | Rep. of Korea | 97-48584 |
| May 28, 1998 | [KR] | Rep. of Korea | 98-19409 |

[51] Int. Cl.[7] ..... H01J 29/18

[52] U.S. Cl. ..... 313/470; 313/472; 313/463

[58] Field of Search ..... 313/472, 463, 313/462, 470, 471; 252/301.16, 301.36

[56] References Cited

U.S. PATENT DOCUMENTS

| | | | |
|---|---|---|---|
| 3,411,029 | 11/1968 | Karr | 313/463 X |
| 4,336,480 | 6/1982 | Koyabashi | 313/495 |

*Primary Examiner*—Ashok Patel

*Attorney, Agent, or Firm*—Christie, Parker & Hale, LLP

[57] ABSTRACT

A pixel for a display device has a shape outlined by a black matrix or a barrier. The pixel is shaped with a polygon having 2(n+1) angled portions where n is a natural number of 2 or more. Such a pixel may be also processed without a previously formed black matrix.

5 Claims, 9 Drawing Sheets

PIXEL FOR DISPLAY AND METHOD OF FORMING SAME

BACKGROUND OF THE INVENTION (a) Field of the Invention

The present invention relates to a pixel for a display device and a method of forming the same and, more particularly, to a method of forming a pixel serving to produce a visual image on the display screen with improved visibility.

(b) Description of the Related Art

Display devices, currently available, include liquid crystal devices (LCDs), plasma display panels (PDPs), vacuum fluorescent displays (VFDs), and cathode ray tubes (CRTs). These display devices are used in TV, monitors, gauge boards, and information boards.

Such a display device has a plurality of pixels which are basic units for forming a screen. The combinations of the pixels produce the desired character or picture images on the screen.

For example, the CRT has a plurality of triodes of pixels formed by phosphors of red (R), green (G) and blue (B) colors, and the PDP has pixels formed by cross-points of electrodes crossed over a matrix.

Such a pixel has an optional pattern characteristic of each type of display devices. This pattern can be outlined by a previously processed black matrix or barrier.

In the CRT, the pixel has a dot or slot shape outlined by a black matrix which is previously formed on the interior surface of a panel. In the LCD, the pixel has a grill or rectangular shape outlined by a black matrix arranged on a color filter. In the PDP or any other flat panel displays, the pixel may be formed with a rectangular shape outlined by a barrier arranged between substrates.

However, such a pixel has a limit in that it cannot be well adapted for use in displaying the digitalized character information or for use in multimedia.

The digitalized character, composed of combinations of rectilinear portions and curved portions, is displayed on the screen wholly with rectilinear lines. Therefore, the visibility of the character displayed on the screen is dependent upon how many rectilinear portions are there in the pixel.

In this viewpoint, the aforementioned pixels may exhibit good visibility with respect to the vertical and horizontal portions of the character because they retain many of the rectilinear lines in those directions. However, with respect to the inclined portions of the character, such pixels reveal limited visibility due to absence of the rectilinear lines in that direction.

Considering that 50% or more portions of the character are displayed on the screen in the inclined direction, it can be easily known that the conventional typed pixels would not be directly applied to advanced multimedia display devices.

SUMMARY OF THE INVENTION

It is an object of the present invention to provide a method of forming a pixel for a display device serving to produce a visual image on the display screen with improved visibility.

In order to achieve these objects and others, the present invention provides a pixel for a display device having a shape outlined by a black matrix or a barrier. The shape of the pixel is formed with a polygon having 2(n+1) angled portions where n is a natural number of 2 or more.

The display device includes a panel, and a phosphor screen formed on an interior surface of the panel and having a plurality of pixels. Each of the pixels is shaped with a polygon having 2(n+1) angled portions where n is a natural number of 2 or more. A shadow mask is mounted within the panel and has a plurality of apertures corresponding to the pixels. Each of the apertures is shaped with a polygon having 2(n+1) angled portions where n is a natural number of 2 or more.

In the pixel formation method, a photosensitive layer is first formed on the interior surface of the panel. Thereafter, a shadow mask is mounted within the panel. The shadow mask has a plurality of apertures shaped with a polygon having 2(n+1) angled portions where n is a natural number of 2 or more. The photosensitive layer is then exposed to light by positioning the central axis of a light source to be placed on a base line traversing opposite angled points of the aperture and vibrating the light source in horizontal and vertical directions. Then, the photosensitive layer forming step, the shadow mask mounting step and the light-exposing step are repeated with respect to the interior surface of the panel with the light-exposed photosensitive layer as many as the number of the lines traversing residual angled points of the aperture. After the repeated processing steps, a graphite layer is formed on the interior surface of the panel with the photosensitive layer. The graphite layer is then etched and developed to thereby form a black matrix on the interior surface of the panel. Thereafter, a phosphor layer is formed on the interior surface of the panel with the black matrix. The phosphor layer is then exposed to light and developed to thereby form a phosphor screen on the interior surface of the panel. The resulting phosphor screen has a plurality of pixels shaped with a polygon having 2(n+1) angled portions where n is a natural number of 2 or more.

Such a pixel may be also processed without a previously formed black matrix.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, wherein.

DETAILED DESCRIPTION OF THE INVENTION

Preferred embodiments of the present invention will be now described with reference to a CRT.

Figure 1:
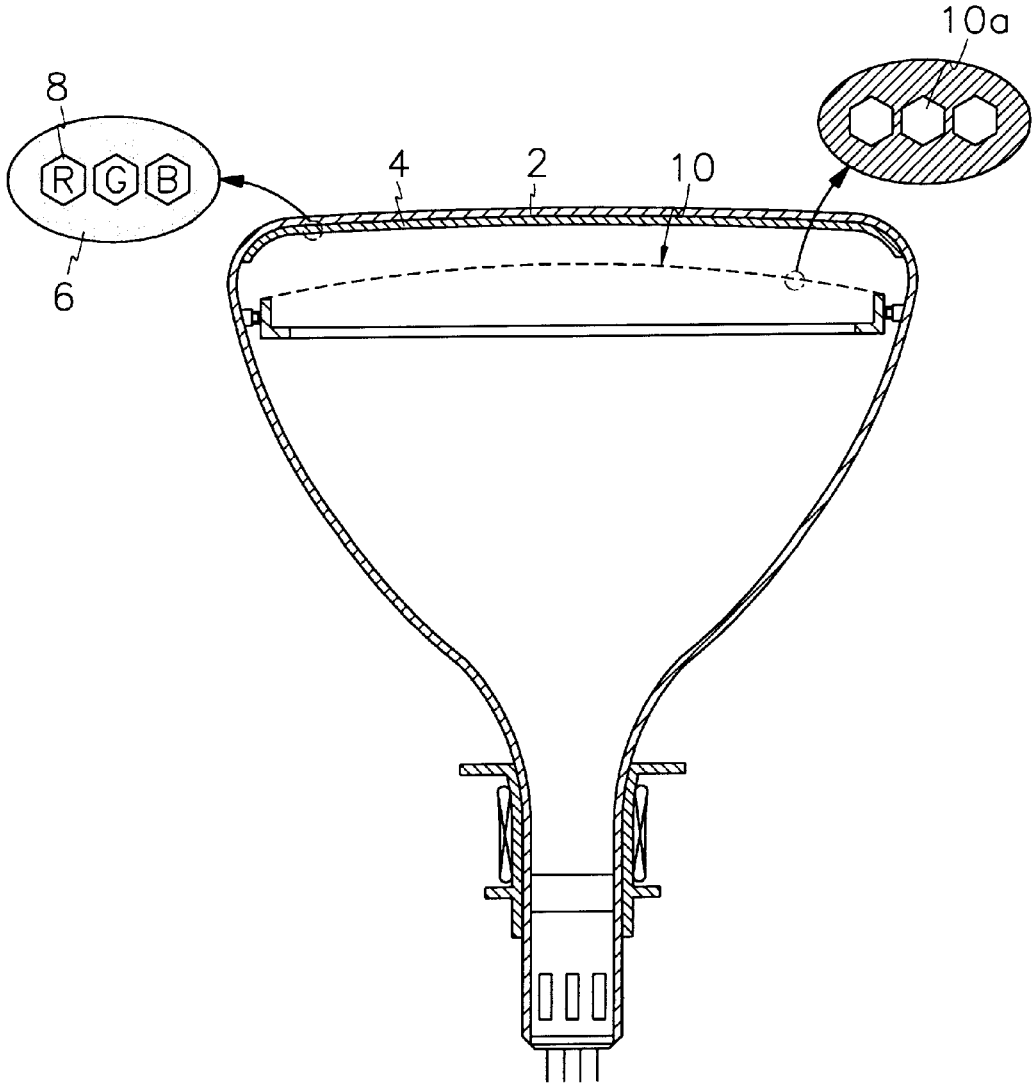
FIG. 1 is a schematic sectional view of a CRT according to a preferred embodiment of the present invention.

FIG. 1 is a schematic sectional view of a CRT according to a preferred embodiment of the present invention. As shown in FIG. 1, the CRT includes a faceplate panel 2 having an inner phosphor screen 4, and a shadow mask 10 placed directly behind the phosphor screen 4. For simplification purpose, explanations with respect to other elements of the CRT shall be omitted in this description.

The phosphor screen 4 is formed with a plurality of triodes of red (R), green (G) and blue (B) pixels 8. Correspondingly, the shadow mask 10 has a plurality of beam-guide apertures 10*a* facing the pixels 8.

The pixel 8 is shaped with a polygon having 2(n+1) angled portions where n is a natural number of 2 or more. In this preferred embodiment, a method of forming a hexagonal shaped pixel will be exemplified.

In order to form the pixel 8, the shadow mask 10 should be first processed in the following way.

Figure 2A:
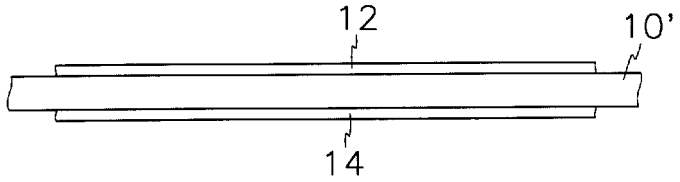
FIGS. 2A to 2D are views illustrating the steps of processing the shadow mask shown in FIG. 1.
Figure 2B:
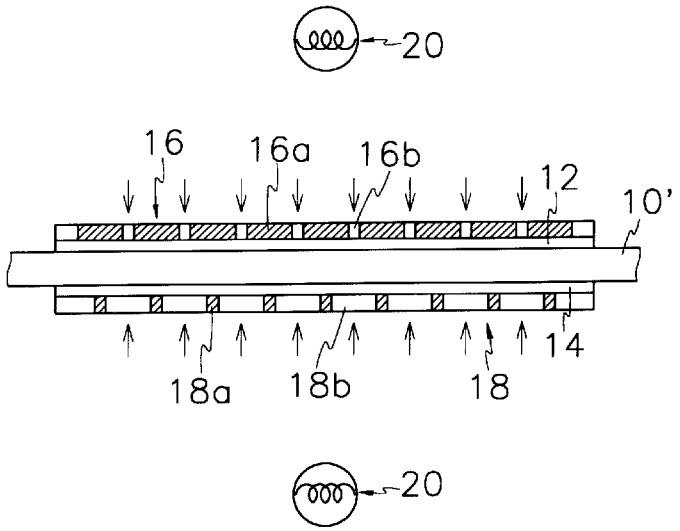

FIGS. 2A to 2D illustrates the steps of processing the shadow mask 10. As shown in FIG. 2A, photosensitive layers 12 and 14 are first formed by applying a photosensitive solution on both sides of a metallic plate 10'. Then, as shown in FIG. 2B, working pattern plates 16 and 18 are arranged on the photosensitive layers 12 and 14, respectively.

Figure 3:
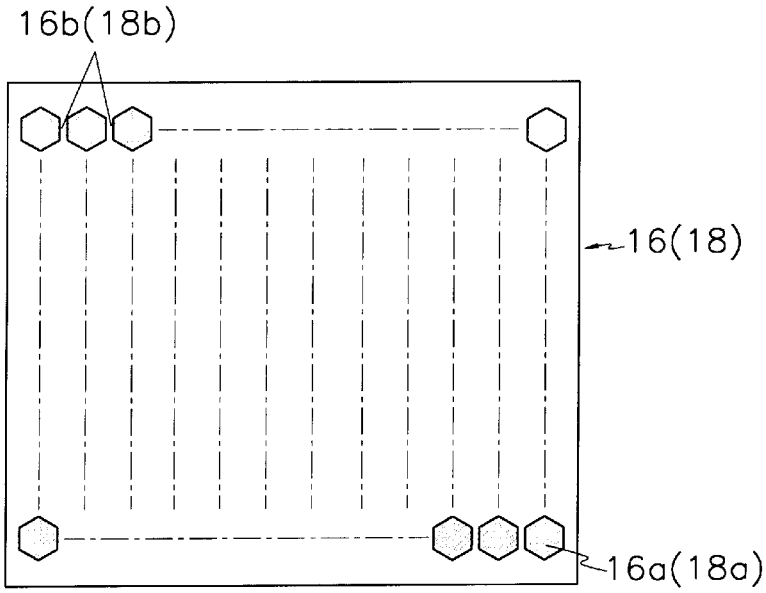
FIG. 3 is a plan view showing a working pattern plate used in the shadow mask processing steps.

FIG. 3 specifically shows such a working pattern plate 16 or 18. The first working pattern plate 16 is formed with graphitized hexagonal shaped portions 16*a* and transparent portions 16*b*. The second working pattern plate 18 has the same structure as the first working pattern glass plate 16. However, the sizes of graphitized hexagonal shaped portions 18*a* and transparent portions 18*b* of the second working plate 18 differ from those of the graphitized portions 16*a* and the transparent portions 16*b* of the first working pattern plate 16.

Figure 2C:
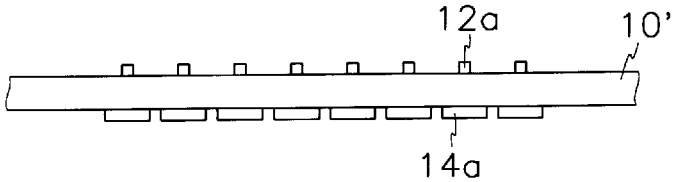

After the working pattern plates 16 and 18 are positioned on their proper places, a light source 20 such as a mercury lamp is arranged adjacent to each of the working pattern plates 16 and 18, and irradiates light thereonto. At this time, the photosensitive layers 10 and 12 are exposed to the light transmitted through the transparent portions 16*b* and 18*b* and, subsequently, developed by a cleaning solution. As a result, as shown in FIG. 2C, only the light exposed portions 12*a* and 14*a* are left over the sides of the metallic plate is 10'.

Figure 2D:
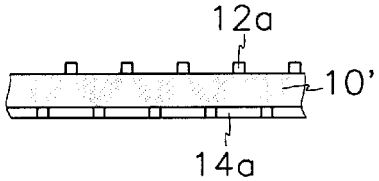

At this state, as shown in FIG. 2D, when the sides of the plate 10' are etched by an etching solution, non-exposing portions of the plate 10' are etched to thereby form hexagonal shaped beam-guide apertures 10*a*. Thereafter, the light-exposed portions 12*a* and 14*a* are removed from the plate 10'.

Finally, the plate 10' with beam-guide apertures 10*a* is processed through a subsequent forming process to be thereby made into a complete shadow mask 10.

Figure 4:
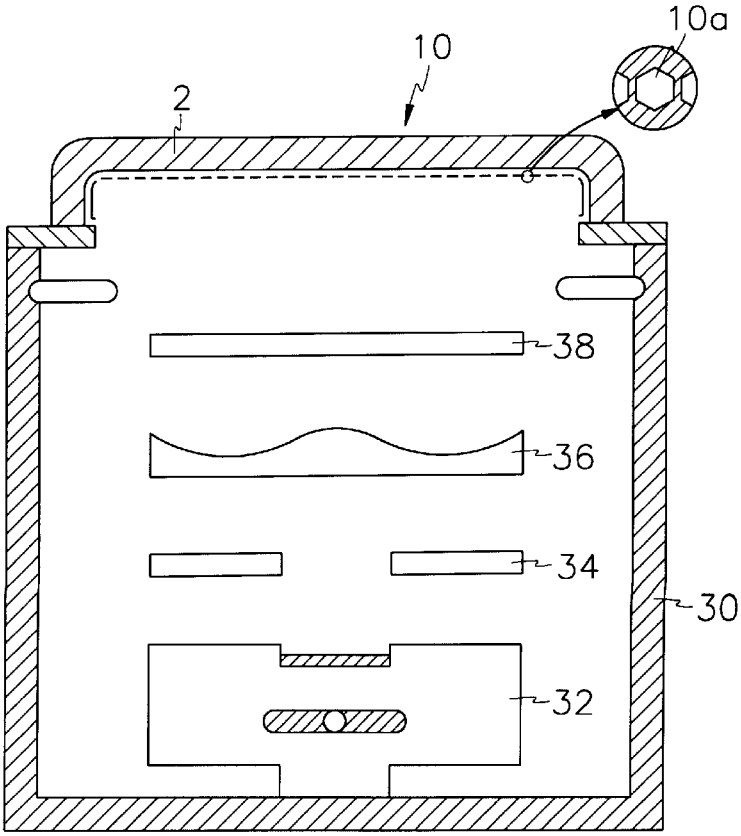
FIG. 4 is a schematic sectional view of a light exposing device for forming a pixel with the shadow mask.

FIG. 4 shows a light exposing device for forming pixels 8 of the phosphor screen 4 with the above-described shadow mask 10. As shown in FIG. 4, the light exposing device includes a main body 30, and a light source 32, a shutter 34, a correction lens 36 and a filter 38 sequentially arranged in the main body 30.

Figure 5:
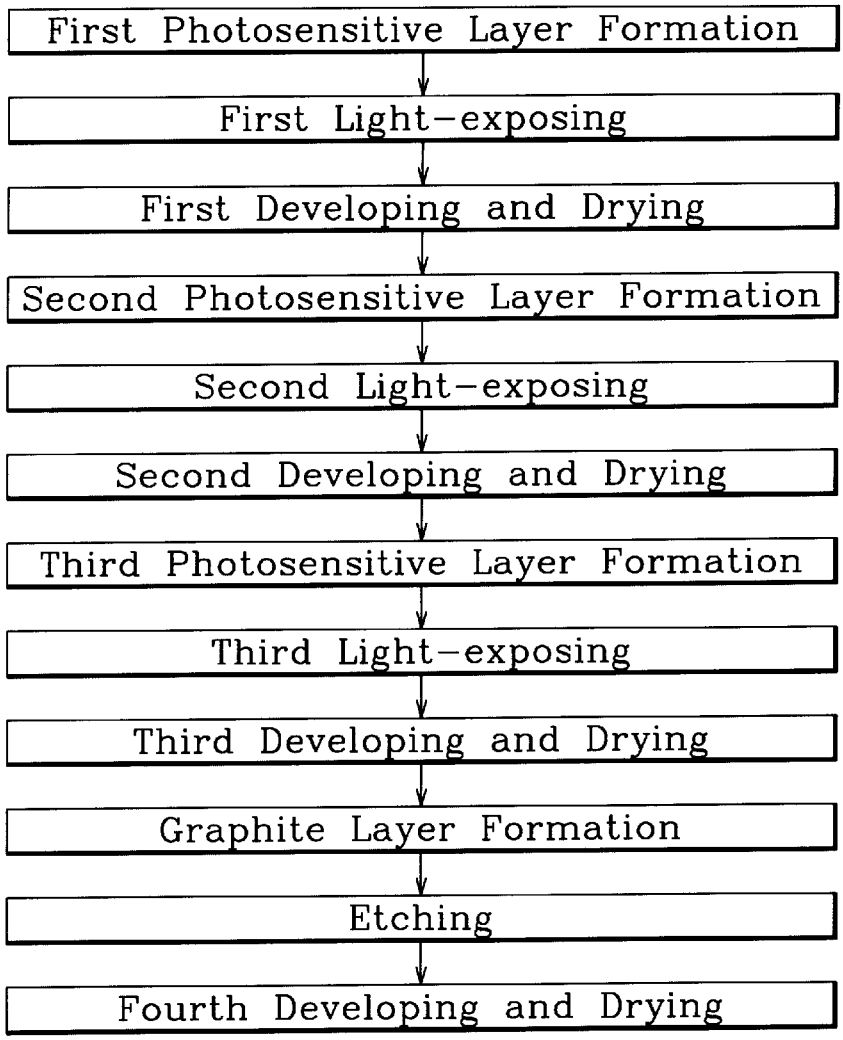
FIG. 5 is a flow chart illustrating the steps of processing a black matrix with the light-exposing device shown in FIG. 4.

In the pixel formation process, a black matrix is first formed on the interior surface of the panel 2. FIG. 5 illustrates such a black matrix formation process. For the first time, a first photosensitive layer is formed on the interior surface of the panel 2. Then, a first light exposing step is performed by mounting a shadow mask 10 with the hexagonal shaped beam-guide apertures 10*a* on the upper opening side of the main body 20 of the light exposing device.

Figure 6:
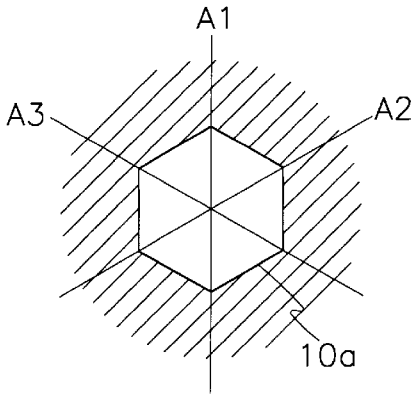
FIG. 6 is a view showing the lines traversing the opposite angled points of a beam-guide aperture of the shadow mask.

In the first light exposing step, the central axis of the light source 32 is positioned on a first line A1, shown in FIG. 6, among the lines traversing the opposite angled points of the beam-guide aperture 10*a*. At this time, the light source 32 irradiates light on the selected portions of the first photosensitive layer through the beam-guide aperture 10*a* while vibrating in the horizontal and vertical directions.

Figure 7A:
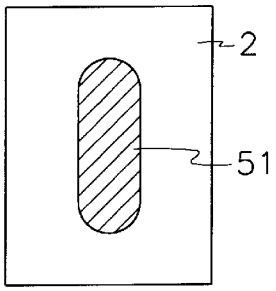
FIGS. 7A to 7C are views illustrating the light-exposing steps of FIG. 5.

Subsequently, a first developing and drying step is performed with respect to the light exposed portions of the first photosensitive layer. As a result, as shown in FIG. 7A, a rectangular shaped layer 51 is produced.

With removal of the shadow mask 10, a second photosensitive layer is formed on the interior surface of the panel 2 while covering the rectangular shaped photosensitive layer 51. Then, the shadow mask 10 is again provided at its proper place and a second light exposing step is performed with respect to the second photosensitive layer while changing the position of the light source 32.

Figure 8A:
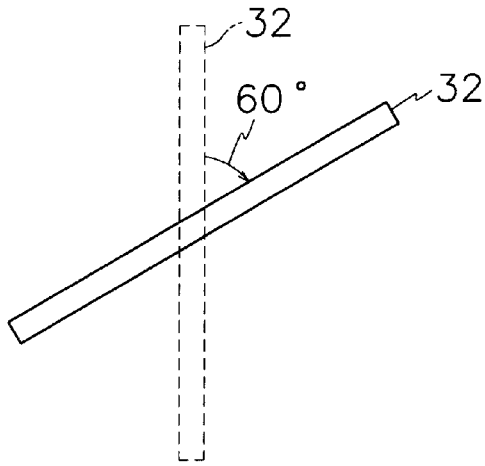
FIGS. 8A and 8B are views showing the position of the light source of the light-exposing device at second and third light-exposing steps.

For this purpose, as shown in FIG. 8A, the light source 32 is rotated by 60 degree from the position in the first light exposing step in the clockwise direction and placed on a second line A2 traversing other opposite angled points of the beam-guide aperture 10*a*. Thereafter, the light source 32 irradiates light on the selected portions of the second photosensitive layer through the beam-guide aperture 10*a* while vibrating in the horizontal and vertical directions.

Figure 7B:
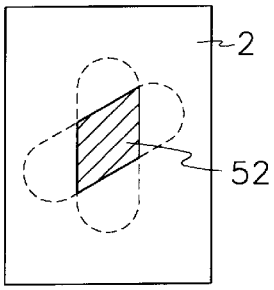

Subsequently, a second developing and drying step is performed with respect to the light exposed portions of the second photosensitive layer. As a result, as shown in FIG. 7B, a diamond shaped photosensitive layer 52 is produced.

Figure 8B:
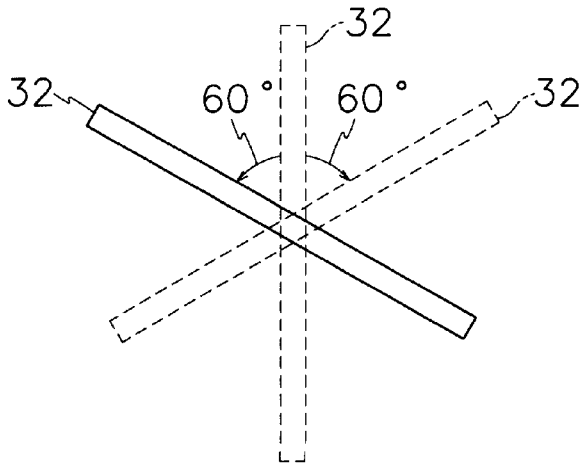

Likewise, a third photosensitive layer formation step, a third light exposing step and a third developing and drying step are performed on the interior surface of the panel 2. In the third light exposing step, as shown in FIG. 8B, the light source 32 is rotated from the second line A2 by 120 degree in the anti-clockwise direction and, hence, its central axis is placed on a third line A3 traversing still other opposite angled points of the beam-guide aperture 10*a*.

Figure 7C:
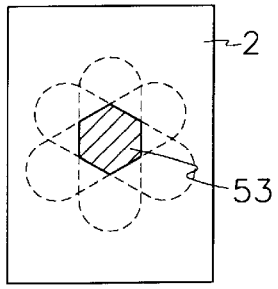

As a result, as shown in FIG. 7C, a hexagonal shaped photosensitive layer 53 is produced. This hexagonal shaped portion is where phosphors will be later coated.

After the hexagonal shaped photosensitive layer 53 is obtained, graphite, which is a black matrix formation material, is coated on the interior surface of the panel 2 while covering the hexagonal shaped photosensitive layer 53. When an etching step, and a fourth developing and drying step are further performed, the photosensitive layer 53 is removed from the interior surface of the panel 2 to thereby obtain a black matrix 6. At this time, the portion, from which the photosensitive layer 53 was removed, is left over with an empty space.

With the black matrix 6, the hexagonal shaped pixels 8 can be obtained by performing the usual phosphor formation process and filling the empty portions with phosphors.

Such hexagonal shaped pixels 8 exhibit good display characteristics described below.

Figure 9:
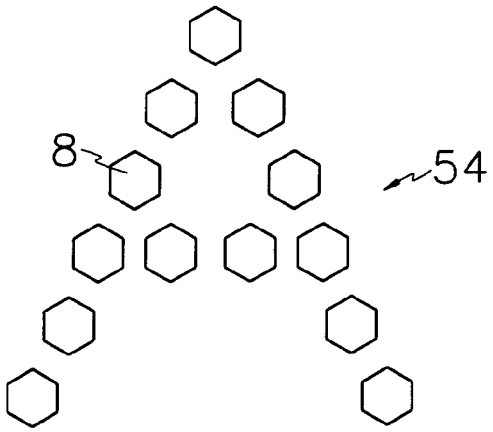
FIG. 9 is an exemplified view showing a character information formed with combinations of pixels shown in FIG. 1.

FIG. 9 exemplifies the case where the character "A" is displayed on the screen with combinations of the hexagonal shaped pixels 8.

In contrast to the character information formed by combinations of the dot or rectangular shaped pixels, such a character information 54 shows an improved visibility in the inclined direction. In this respect, considering that 50% or more portions of the character information are displayed in the inclined direction of 30 to 60 degree, it is easily known that the hexagonal shaped pixels 8 can serve to produce screen images with relatively better visibility.

Furthermore, it was demonstrated through repeated experiments that the hexagonal shaped pixels 8 serve to improve visibility of the English, Korean or Chinese character displayed on the screen.

A second embodiment of the present invention will be also explained with reference to a CRT.

Figure 10:
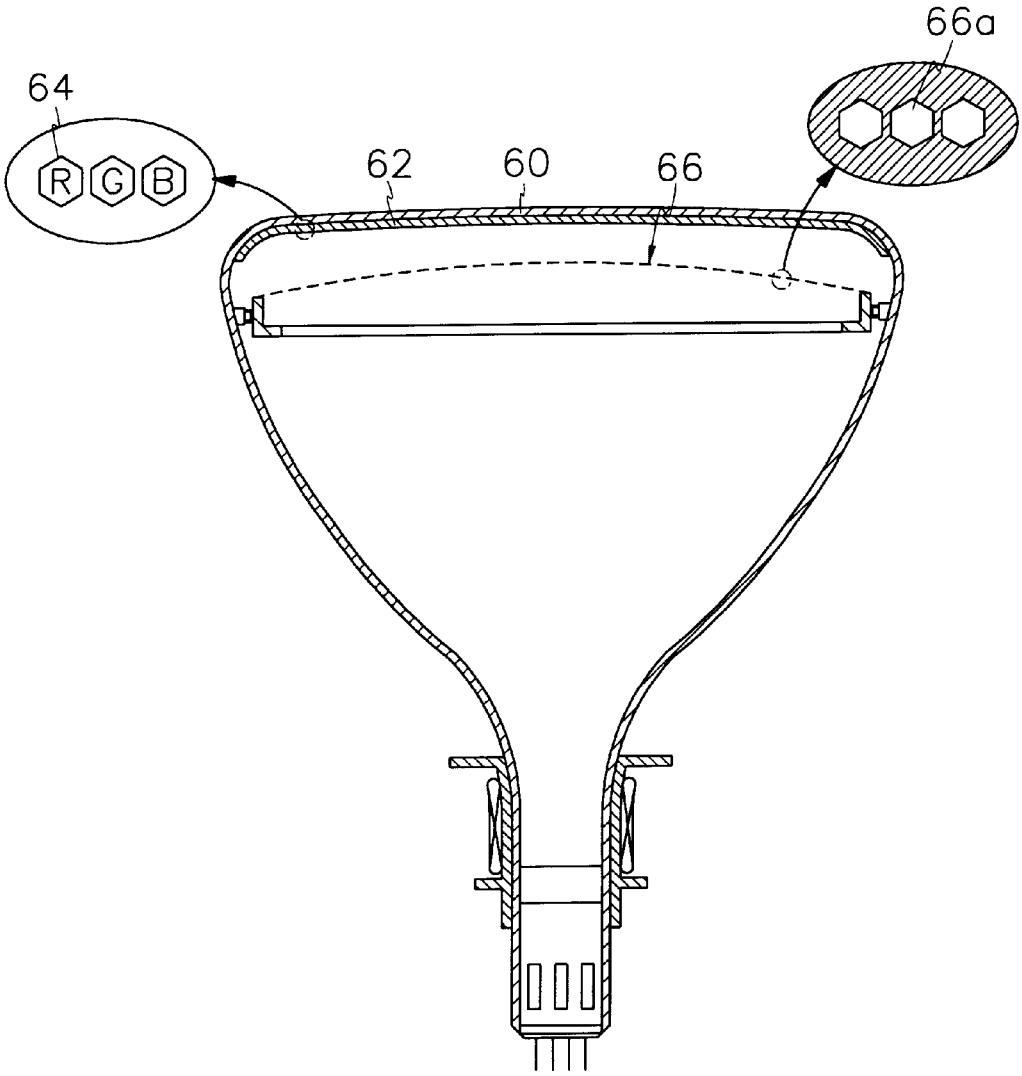
FIG. 10 is a schematic sectional view of a display device according to a second preferred embodiment of the present invention.

FIG. 10 shows a CRT according to the second preferred embodiment of the present invention. As shown in FIG. 10, the CRT includes a faceplate panel 60 having an inner phosphor screen 62, and a shadow mask 66 placed behind the phosphor screen 62.

As is in the first preferred embodiment, the phosphor screen 62 is formed with a plurality of hexagonal shaped pixels 64. However, in this preferred embodiment, the pixels 64 are processed without a previously formed black matrix. The pixels corresponding to R, G and B colors are successively formed on the interior surface of the panel 60.

Of course, the shadow mask 66 with a plurality of hexagonal shaped beam-guide apertures is still required in the pixel formation process. The shadow mask processing steps are the same as those of the first preferred embodiment.

In the pixel formation process, except for the light exposing step, other processing steps are performed in the usual way. As is in the first preferred embodiment, the light exposing step is performed by positioning the central axis of the light source on each of the lines traversing the opposite interior angles points of the pixel 64 and vibrating the light source in the horizontal and vertical directions at each place.

In this way, the resulting pixel 64 can be formed with a hexagonal shape. Therefore, as described above, the character information displayed on the screen with combinations of the hexagonal shaped pixels exhibits improved visibility characteristic.

A third embodiment of the present invention will be further explained with reference to a CRT.

Figure 11:
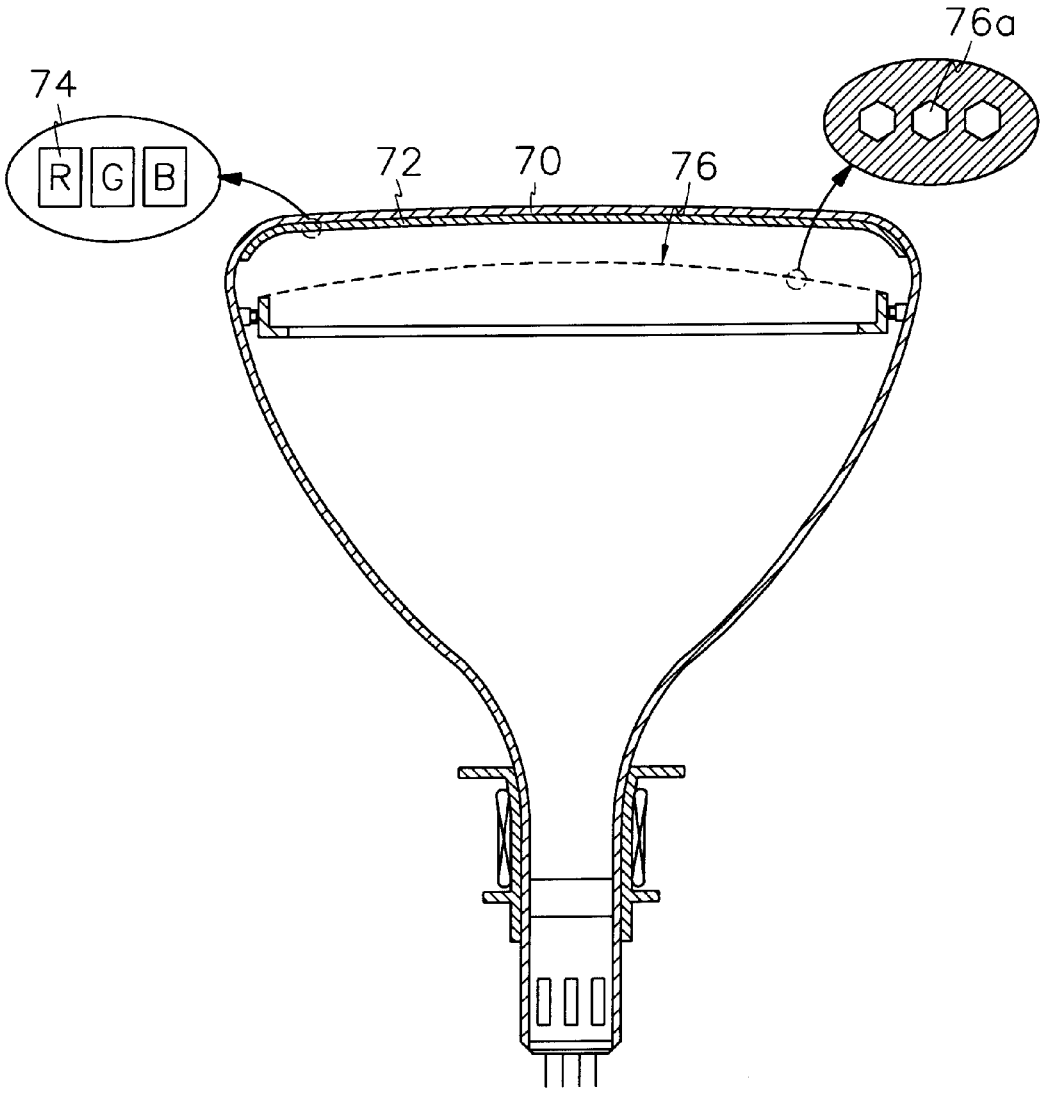
FIG. 11 is a cross sectional view of a display device according a third preferred embodiment of the present invention.

FIG. 11 shows a CRT according to the third preferred embodiment of the present invention. As shown in FIG. 11, the CRT includes a faceplate panel 70 having an inner phosphor screen 72, and a shadow mask 76 placed behind the phosphor screen 72.

In this preferred embodiment, each of pixels 74 of the phosphor screen 72 is formed with a slot shape. In contrast, as is in the previous embodiments, each of beam-guide apertures 76*a* of the shadow mask 76 is formed with a hexagonal shape.

The size of the beam-guide aperture 76*a* is established to be smaller than that of the pixel 74.

In this way, the electron beam passing the beam-guide aperture 76*a* can land on the phosphor screen 72 with a hexagonal shape. This creates the same effect as with the hexagonal shaped pixels according to the previous embodiments.

In the aforementioned preferred embodiments, it was explained that the developing step would be repeated after each light exposing step. However, it is also possible to perform the developing step only once after all of the light exposing steps are completed.

In the light exposing step, the light source 32 vibrates in the horizontal and vertical directions preferably with amplitudes in the range of 0~2 mm and 0~3 mm, respectively. Furthermore, it is preferable that as the light exposing operation is repeated with the light source at different positions, the light exposing time is gradually reduced in view of the light exposing degree at each position.

As described above, the hexagonal shaped pixels according to the present invention can serve to give relatively better visibility to the displayed screen images and, hence, can be well applied for the multimedia use.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A display device having a phosphor screen, comprising:

a panel;

a phosphor screen formed on an interior surface of the panel and having a plurality of pixels, each of the pixels having a shape outlined by a black matrix or a barrier, wherein the shape of each of the pixels is formed with a polygon having 2(n+1) angled portions where n is a natural number of 2 or more.

2. The display device of claim 1 wherein the display device is a cathode ray tube.

3. A display device, comprising:

a panel;

a phosphor screen formed on an interior surface of the panel and having a plurality of pixels, each of the pixels being shaped with a polygon having 2(n+1) angled portions where n is a natural number of 2 or more; and a shadow mask mounted within the panel and having a plurality of apertures each corresponding to one of the pixels, each of the apertures being shaped with a polygon having 2(n+1) angled portions where n is a natural number of 2 or more.

4. A display device, comprising:

a panel;

a phosphor screen formed on an interior surface of the panel and having a plurality of pixels, each of the pixels being formed with a predetermined shape; and a shadow mask mounted within the panel and having a plurality of apertures each corresponding to one of the pixels, each of the apertures being shaped with a polygon having 2(n+1) angled portions where n is a natural number of 2 or more, and having a size smaller than the size of the pixel.

5. A display device comprising a faceplate panel having an interior surface with a plurality of phosphor pixels each having a polygonal shape with 2(n+1) sides, where n is an integer greater than 1.

* * * * *